US005634500A

United States Patent [19]

Clüsserath et al.

[11] Patent Number: 5,634,500

[45] Date of Patent: Jun. 3, 1997

[54] METHOD FOR BOTTLING A LIQUID IN BOTTLES OR SIMILAR CONTAINERS

[75] Inventors: Ludwig Clüsserath, Bad Kreuznach; Manfred Hartel, Bretzenheim, both of Germany

[73] Assignee: KHS Maschinen- und Alnagenbau AG, Dortmund, Germany

[21] Appl. No.: 517,159

[22] Filed: Aug. 18, 1995

[30] Foreign Application Priority Data

Aug. 20, 1994 [DE] Germany ..... 44 29 594.4

[51] Int. Cl.[6] ..... B67C 3/10

[52] U.S. Cl. ..... 141/48; 141/49; 141/52; 141/44; 141/63

[58] Field of Search ..... 141/5–7, 44–50, 141/63

[56] References Cited

U.S. PATENT DOCUMENTS

| | | | |
|---|---|---|---|
| 4,848,419 | 7/1989 | Damen | 141/5 X |
| 5,031,673 | 7/1991 | Clusserath | 141/6 |
| 5,054,527 | 10/1991 | Rozier | 141/48 X |
| 5,329,963 | 7/1994 | Jones et al. | 141/6 |
| 5,501,253 | 3/1996 | Weiss | 141/7 X |

FOREIGN PATENT DOCUMENTS

| | | |
|---|---|---|
| 0536906 | 4/1993 | European Pat. Off. . |
| 3742433 | 7/1988 | Germany . |

*Primary Examiner*—J. Casimer Jacyna
*Attorney, Agent, or Firm*—Nils H. Ljungman & Associates

[57] ABSTRACT

In a method for filling bottles or similar containers with a liquid under back pressure, at least a first flushing and a second flushing of the interior of the respective bottle are conducted in chronological sequence during a pre-treatment phase which precedes the actual priming of the respective container, by the timed introduction of a specified quantity of inert gas, with a subsequent evacuation of the interior of the bottle. The introduction of the specified quantity of inert gas takes place in a timed manner during each flushing, and is performed independently of the capacity at which the bottling system is currently being operated.

11 Claims, 2 Drawing Sheets

927mL AIR
1030mL
103mL AIR

100% $CO_2$
250mL $CO_2$
250mL $CO_2$
103mL AIR

177mL $CO_2$
73mL AIR
1030mL
73mL $CO_2$
30mL AIR

100% $CO_2$
250mL $CO_2$
323mL $CO_2$
30mL AIR 228.8mL $CO_2$
21.2mL AIR
1030mL
94.2mL $CO_2$
8.8mL AIR

100% $CO_2$
3502mL $CO_2$
3605mL (2.5 BAR G)
3596.2mL $CO_2$
8.8mL AIR

METHOD FOR BOTTLING A LIQUID IN BOTTLES OR SIMILAR CONTAINERS

BACKGROUND OF THE INVENTION

1. Field of the Invention

The present invention relates to a method for filling bottles, e.g., in a rotary bottle filling machine.

2. Background Information

The known art has described methods for bottling a liquid, in particular beverages (and especially beer), in bottles or similar containers. In the known art, it is conventional to flush the respective container with inert gas before the actual priming in a pretreatment phase and/or to establish an underpressure in the container, i.e., to evacuate it.

To guarantee the quality and preservation of the contents, in particular with a liquid which is sensitive to oxygen, care must generally be taken that the concentration of air and thus oxygen in the primed container is as low as possible. To guarantee an efficient and economical bottling process, however, attempts must also generally be made to keep the consumption of expensive inert gas, which is generally CO2 gas but can also be nitrogen (N2), as low as possible. The used inert gas, including in particular the used CO2 gas, is also usually released into the atmosphere.

OBJECT OF THE INVENTION

One object of the present invention is the provision of a method which meets the requirements indicated above, which are at least to some extent contradictory, and which guarantees the lowest practicable consumption of inert gas while achieving the lowest practicable concentration of air or oxygen in the primed container.

Another object of the present invention is the provision of a method of preparing bottles for filling which permits the lowest consumption of inert gas and which produces bottles with a low specific concentration of air and/or oxygen ready for filling.

Yet another object of the invention is the provision of method of flushing and filling bottles that can be readily modified whenever the capacity of the bottles (e.g., 1 liter, 750 ml) being filled is changed.

SUMMARY OF THE INVENTION

The inventive method reliably guarantees that the respective primed container contains only an extremely small percentage of air or oxygen. The inventive method is therefore suitable for the bottling of a liquid which is sensitive to oxygen, i.e., in particular for the bottling of beverages which are sensitive to oxygen, whereby a priority field of application of the invention is the bottling of beer.

The duration of the application of an underpressure to the respective container (evacuation of the container) and the intensity of the flushing, as well as the quantity of inert gas fed to the respective container, are timed, and in a bottling machine of the rotary design which uses this bottling system, are independent of the speed of rotation and capacity (e.g., bottles per unit time) at which this machine is being operated.

In one preferred embodiment of the invention, each flushing is preceded by an evacuation of the container, so that at the beginning of each flushing, there is a precisely defined pressure inside the respective container. Thus by means of a timed or timing function, the quantity of the inert gas introduced into the container during the flushing can be precisely controlled. There is also preferably an evacuation of the container at the end of the pretreatment phase, i.e., immediately preceding the priming phase.

BRIEF DESCRIPTION OF THE DRAWINGS

The invention is explained below with reference to the embodiment illustrated in the accompanying figures.

DESCRIPTION OF THE PREFERRED EMBODIMENT

Figure 1:
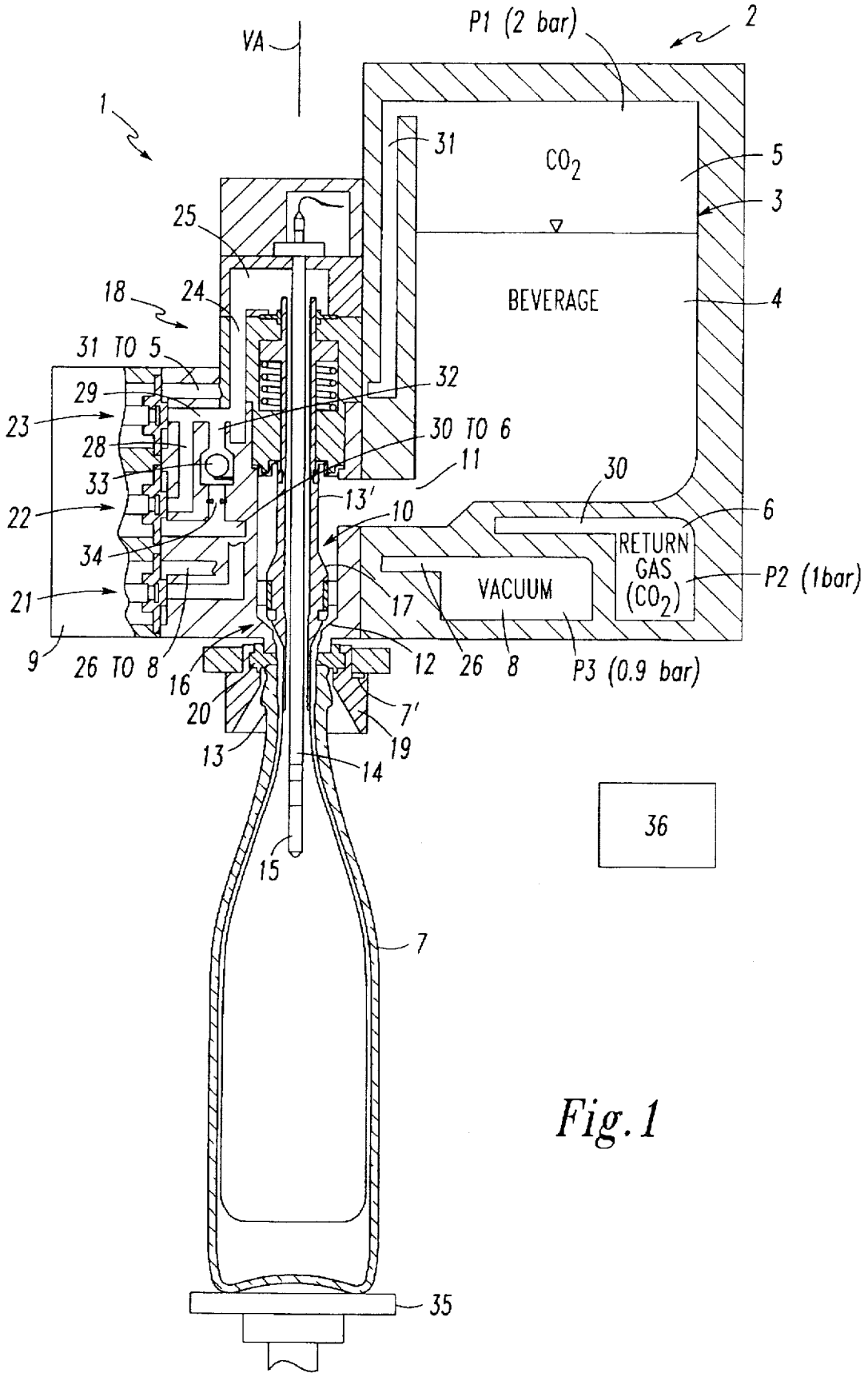
FIG. 1 is a simplified drawing in cross section of a bottling element, without a bottling tube, for bottling a liquid in bottles under back pressure.

In FIG. 1, there is shown a bottling element 1 which, together with a multiplicity of identical bottling elements, is located on the circumference of a rotor 2 which revolves around a vertical machine axis of a bottling machine which employs a rotary design. On the rotor 2, there is also a toroidal boiler (or tank) 3 which is common to all the bottling elements 1 and which also surrounds the vertical machine axis concentrically, and is used to hold and feed the liquid to be bottled to the individual bottling elements 1. The toroidal boiler 3 is filled with this liquid up to a specified level N, so that a gas chamber 5 is formed above the level N, or above the space 4 occupied by the liquid inside the toroidal boiler 3. The toroidal boiler 3 or its fluid chamber 4 is connected to a line (not shown in great detail in FIG. 1) for the feed of the liquid being bottled. The gas chamber 5 is also connected by means of a line (not shown in great detail in FIG. 1) to a source for an inert compressed gas (preferably CO2 gas), so that when the bottling machine is in operation, the gas chamber 5 is at a specified constant overpressure (the bottling pressure P1).

On the rotor 2, there is also a return gas collecting line 6 which is common for all of the bottling elements, and which operates as described below to, among other things, collect the CO2 gas which is displaced from the bottles 7 during the filling of the bottles, and in which a specified overpressure P2 is established. In relation to an atmospheric pressure, the bottling pressure P1 can, for example, be a 2 bar overpressure, and the pressure P2 in the return gas collecting line 6 can, for example, be approximately 1 bar overpressure.

Finally, on the rotor 2, there is also a common vacuum duct 8 for all of the bottling elements 1, and which is connected by means of a line to an underpressure source, and can have, for example, an underpressure P3 of 0.9 bar, once again with respect to the atmospheric pressure.

Each bottling element 1 has a housing 9, in which there is a liquid duct 10, the one end of which duct is connected by means of an opening 11 to the liquid chamber 4. The other end of the liquid duct 10 forms a ring-shaped discharge opening 12 for the liquid being bottled on the underside of the bottling element 1 or of the housing 9, which discharge opening 12 concentrically surrounds a return gas tube 13' forming a return gas duct 13. The return gas duct 13 is a part of the gas path for the flushing, evacuation, priming, etc., as described in greater detail below.

In the return gas tube 13' which projects beyond the underside of the bottling element 1 and is open on its lower end, there is mounted a conventional probe 14 which measures the filling level. This probe projects downward with its end having a probe contact 15 beyond the return gas tube 13', and is oriented with its axis coaxial with the axis of the return gas tube 13' and with the vertical axis VA of the bottling element 1.

In the liquid duct 10, there is also a conventional liquid valve 16, which has a valve body 17 which, in the illustrated embodiment, is manufactured in one piece with the return gas tube 13', and can be moved by means of a pneumatic actuator device 18 a specified distance along the axis VA of the bottling element between a raised position, which opens the liquid valve 16 and which is illustrated in FIG. 1, and a lowered position, which closes the liquid valve 16.

On the underside of the bottling element 1 or of the housing 9, there is also a centering bell 19, against which, or against the seal 20 of which, the respective bottle 7 is in tight contact with its mouth 7' during the bottling process, and which for its part is in tight contact against the underside of the housing 9, so that when the bottle 7 is pressed against the bottling element 1, the interior of this bottle is sealed from the outside, and the discharge opening 12 is in communication with the liquid duct 10. When the bottle 7 is in contact with the bottling element 1, the return gas tube 13' and the probe 14 extend through the mouth 7' of the bottle into the interior of the bottle 7.

Each bottling element 1 also has a control valve device, which in the illustrated embodiment includes three valves 21, 22 and 23 which can be controlled individually, are designed as pneumatically actuated valves, and are connected in the manner described below:

Valve 21:

On the input side via a duct 24 to a chamber 25 and on the output side via a duct 26 to the vacuum duct 8.

The chamber 25 is, in turn, in communication with the upper end of the ring-shaped return gas duct 13 which is inside the return gas tube 13' and surrounds the probe 14.

Valve 22:

On the input side, via duct segments 28 and 29 and the duct 24 with the chamber 25, and on the output side via a duct 30 with the return gas collecting duct 6.

Valve 23:

On the input side with the chamber 25 via the duct 29 and duct 24, and on the output side with the gas chamber 5 via a duct 31, which is located partly in the housing 9 and partly in the rotor 2 or toroidal boiler 3.

In the housing 9 of each bottling element, there is also a duct 32 which connects the output of the valve 22 with the input of the valve 23, i.e. the duct 30 with the duct 29, and thus the return gas collecting duct 6 with the chamber 25, and in which, connected in series, are located a ball valve and/or non-return valve 33 and a throttle 34, in which the non-return valve 33 is located so that it closes when the pressure in the chamber 25 drops below the pressure P2 of the return gas collecting duct 6.

With the bottling element 1 or with the bottling system which includes this bottling element 1, the method of operation described below is possible, among other things, whereby before the start-up of the corresponding bottling machine, of course, the toroidal boiler 3 is filled up to the specified level N with the liquid being bottled, the gas chamber 5 and the return gas collecting duct 6 each have the necessary CO2 gas pressure P1 and P2 respectively, and the vacuum duct 8 is at the necessary underpressure P3. In the following description, it is also assumed that the valves 21–23 and the liquid valve 16 are all in the closed position during the individual process steps, unless the open position is specifically indicated for the respective valve.

1. Evacuation of the bottle 7

The respective bottle 7 is raised by a stroke mechanism, of which only a bottle plate 35 is shown in FIG. 1, in the conventional manner, from below to the bottling element 1, and is placed so that its mouth 7' is sealed against the bottling element 1. Then the valve 21 is opened by the electronic control device 36, whereupon a gas path of a connection is created via the ducts 26 and 24, the chamber 25 and the return gas duct 13 and the open valve 21, or between the interior of the bottle 7 and the vacuum duct 8 for the evacuation of the bottle 7. The non-return valve 33 is thereby in the closed position, since the pressure in the chamber 25 is significantly less than the pressure P2 in the return gas collecting duct 6.

Figures 2A, 2B, 2C, 2D, 2E, 2F:
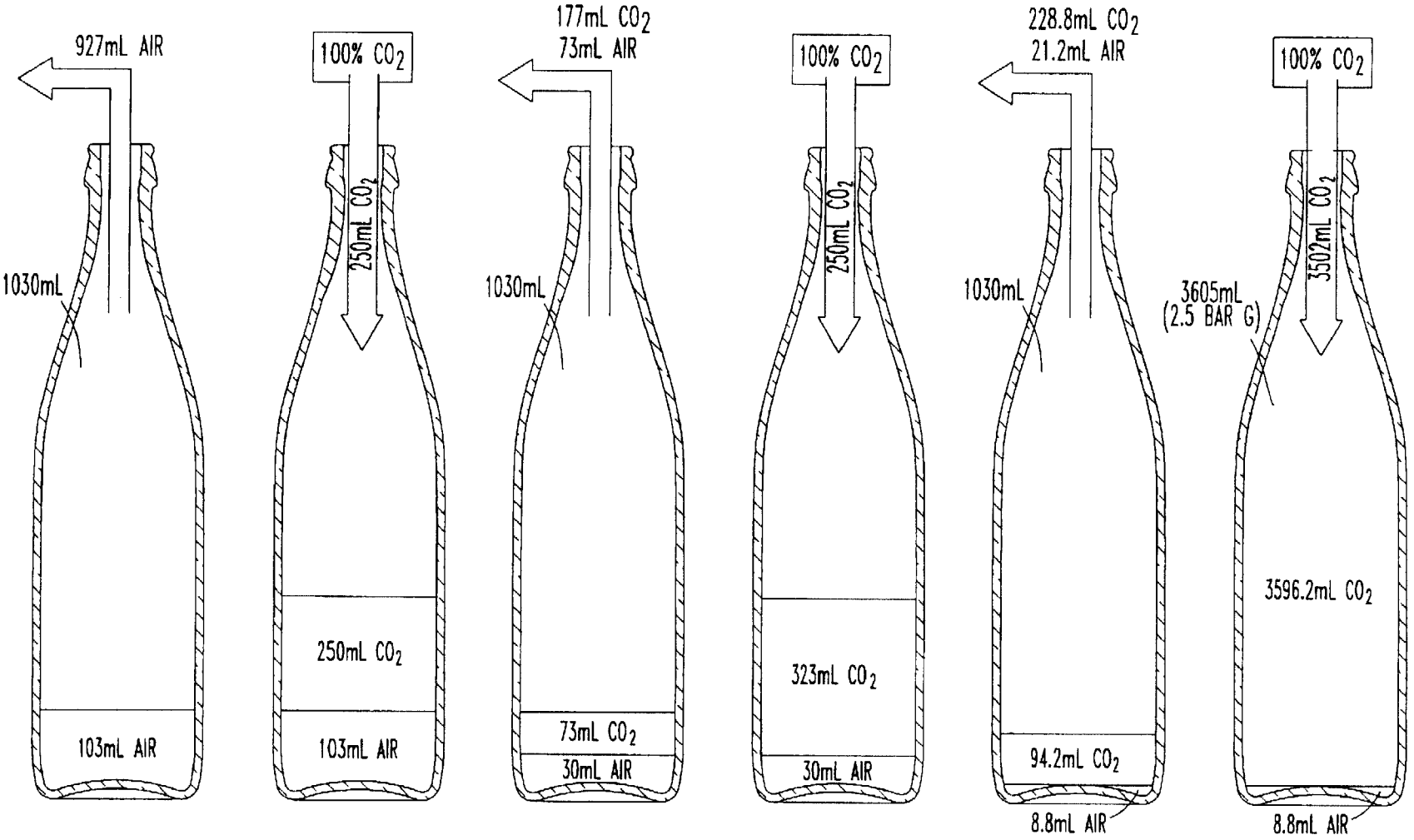
FIG. 2 shows, in FIGS. 2*a–f*, the process steps which precede the actual bottling phase in one embodiment of the invention, specifically to illustrate the quantities of air and gas which are extracted from the respective bottle in these process steps, as well as the quantity of CO2 gas which is injected into the corresponding bottle.

This process step, which is illustrated in FIG. 2*a*, is in particular controlled by the selection of the underpressure P3 in the vacuum duct 8, so that a vacuum of approximately 90% is created in the respective bottle 7, i.e., only approximately 10% of the original quantity of air in the bottle remains in it.

If the bottle 7 is a 1.0 liter bottle with a total volume of 1030 ml, approximately 103 ml of air may remain in the bottle 7 at the end of this process step, i.e., 927 ml of air may be removed.

2. First flushing of the bottle with CO2 gas

After the end of an evacuation period, the length of which can be selected as desired by means of an appropriate electronic control device 36, the valve 21 is closed again. Simultaneously or subsequently, the valve 22 opens, which then creates a communication between the interior of the bottle 7 and the return gas collecting duct 6, namely for a first flushing of the interior of the bottle 7 with CO2 gas from this return gas collecting duct. By means of the electronic control system 36, the opening time of the valve 22 is selected or controlled so that the quantity of CO2 gas which is introduced into the bottle 7, which at the pressure P2 of the return gas collecting duct 6 corresponds to approximately one-quarter of the total volume of the bottle, i.e., approximately 250 ml.

By means of the control device 36, the flushing time can be varied so that, among other things, the quantity of flushing gas for this first flushing can be made as large as possible.

3. Second evacuation of the bottle

Following the completion of the first flushing time, the valve 22 is closed once again. Immediately thereafter, the valve 21 is opened and thus a connection is created between the interior of the bottle 7 and the vacuum duct 8. There is a repeated evacuation of the bottle 7 via the return gas duct 13 to a vacuum of approximately 90%, i.e., as illustrated in FIG. 2*c*, approximately 177 ml of CO2 gas and 73 ml of remaining air are discharged from the bottle, so that approximately 73 ml of CO2 gas and 30 ml of air remain in the bottle 7.

4. Second flushing of the bottle with CO2 gas

Following the end of the time for the second evacuation, which can be selected as desired via the electronic control system 36, the valve 21 is closed once again. Analogous to the process step 2, the valve 22 is opened and CO2 gas is once again injected from the return gas collecting duct 6 into the interior of the bottle 7, namely a controlled quantity of gas which, at the pressure P2, corresponds to approximately one-quarter of the total volume of the bottle 7, i.e., approximately 250 ml. Here again, the quantity of CO2 gas introduced is controlled by controlling the time the valve 22 is open. By extending the opening or flushing time, the quantity of CO2 gas introduced can be changed, e.g., increased.

At the end of this step of the process, which is illustrated in FIG. 2*d*, approximately 323 ml of CO2 gas and 30 ml of air may be in the bottle 7.

5. Third evacuation of the bottle

To initiate this step of the process, which can also be called the final evacuation of the bottle 7, the valve 22 is closed once again. Immediately after the closing of the valve 22, the valve 21 is opened once again, which creates a connection between the interior of the bottle 7 and the vacuum duct 8, and there is a repeated evacuation of the bottle 7 by means of the return gas duct 13 to a vacuum of approximately 90%. This step of the process is illustrated in FIG. 2*e*.

In the example described above, in this process step approximately 21.2 ml of air and 228.8 ml of CO2 gas can be discharged from the bottle, so that 94.2 ml of CO2 gas and only 8.8 ml of air could remain.

6. Priming with CO2 gas.

The valve 21 is closed by a timer. Simultaneously or immediately thereafter, the valve 23 is opened, whereupon a connection is created between the interior of the bottle 7 and the gas chamber 5, namely by means of the ducts 31 and 24, the chamber 25, the return gas duct 13 and the open valve 23. The interior of the bottle 7 is primed by means of the CO2 gas from the gas chamber 5, which can have a high concentration (99.0–99.9%) of CO2, and namely at the bottling pressure P1 set in the gas chamber 5.

The quantity of CO2 gas injected into the bottle 7 during the process step illustrated in FIG. 2*f* can correspond to approximately 2987 ml at the pressure P1. After the priming, only a very small quantity of air remains in the bottle 7, i.e., the CO2 concentration in the bottle can be approximately 99.7% at the end of the priming.

During the priming, of course, the non-return valve 33 opens, but the small pressure loss via the throttle 34 can be ignored, because the CO2 gas which escapes from the gas chamber 5 via the throttle 34 reaches the return gas collecting duct 6, and from there it can be used for the first and second flushing (process steps 2 and 3 above).

7. Slow filling

At the end of the priming, the valve 23 is closed to interrupt the connection between the bottle 7 and the gas chamber 5. Immediately thereafter, the liquid valve 16 is opened. On account of the pressure difference between the interior of the bottle 7 and the return gas collecting duct 6, the ball valve 33 remains open. The throttle 34 throttles the CO2 gas current which is displaced out of the bottle 7 into the return gas collecting duct 6, and thereby guarantees a smooth, slow filling rate.

The actual filling rate thereby achieved results from the effective cross section of the throttle 34 and the pressure difference between the gas chamber 5 and the return gas collecting duct 6. These parameters can be set as a function of the sensitivity of the liquid being bottled. The duration of the bottling phase is controlled by the electronic control system 36, and can be limited to a few hundred milliseconds, for example.

8. Rapid filling

In this process step, the valve 23 is opened, so that via the return gas duct 13 and the open valve 23, there is an unthrottled gas path into the gas chamber 5, namely in addition to the gas path via the throttle 34, by means of which the filling rate can be adjusted, and is determined essentially by the static difference in altitude between the level N of the liquid in the toroidal boiler 3 and in the respective bottle 7.

The duration of this rapid filling phase is either controlled centrally for all the bottling elements 1 of the bottling machine by means of the electronic control system 36 by selecting the desired time, or individually for each bottling element or for each bottle 7 by means of the probe 14 or by means of the probe contacts 15 provided on the lower end of this probe.

9. Return to slow bottling and make-ups

Following the completion of the rapid filling phase, the valve 23 is closed again, so that the same filling rate is set as during the slow bottling. Following the response of the probe 14, the liquid valve 16 is closed, following the end of an adjustable make-up time, if necessary.

10. Preliminary depressurization, settling and residual depressurization

Following the closure of the liquid valve 16, the valve 22 is opened and the interior of the bottle 7 is preliminarily depressurized to the pressure of the return gas collecting duct 6.

For the residual depressurization, following the closing of the valve 22, there is a brief opening of the valve 21 controlled by the electronic control system 36, preferably so that after the reclosing of the valve 21 and immediately before the subsequent extraction of the bottle 7 from the bottling element 1, there is only a slight overpressure remaining in this bottle.

The method described above has the advantage that if there is a high CO2 gas concentration in the respective bottle at the end of the priming (process step 6), an extraordinarily low consumption of CO2 gas is achieved. With a hypothetical quantity of CO2 gas or flushing gas of ¼ of the volume of the bottle at an overpressure of approximately 1.0 bar in the return gas collecting duct 6, the CO2 consumption will likely be less than 200 g per hl of liquid bottled, i.e., especially in the example illustrated in FIGS. 2*a*–2*f*, the CO2 consumption is approximately 100 g per hl.

This low CO2 consumption, when there is a high CO2 concentration in the bottle after the priming, is due, among other things, to the multiple intermediate flushings (first and second flushing) with evacuation, and to the fact that the return gas displaced from the primed bottle 7 during the bottling phase flows completely into the return gas collecting duct 6 and into the gas chamber 5, and thus can be reused for the flushing and priming of the bottles 7. The actual consumption of CO2 gas thus results from the quantities of gas which flow during the second and third evacuation, and during the residual depressurization into the return gas collecting duct 6.

The employment of an electronic control means which can precisely and accurately time the various sequences of evacuation and flushing allows the invention to achieve two of its principle objects, the consumption of as little inert gas as is practicable, while at the same time ensuring that the bottles are as free of air and/or oxygen as is also practicable, objects which are to some extent contradictory. This is due to the fact that precise timing of the gas flows from sources at known pressures permits relatively precise amounts of inert gas to be introduced into the bottles. The same is true of the evacuation steps. Thus, there is no wasted inert gas such as might be the case with known methods where it may be considered safe to err on the side of overconsumption of inert gas.

Moreover, the electronic control means allows a very easy changeover of the bottling machine between bottles of various capacities, for example, a changeover from 1 liter bottles to 750 ml bottles, since no mechanical adjustments are necessary to alter the evacuation and flushing times and volumes. Rather, all that is needed is the execution of a different or modified control program.

Examples of filling machines that utilize electronic control devices to control various portions of a filling or bottling process and which may be utilized in connection with the present invention are to be found in U.S. Pat. No. 5,273,082 issued to Paasche et al. on May 27, 1992 and entitled "Method and Apparatus for Filling Containers" and U.S. Pat. No. 5,301,488 issued to Ruhl et al. on Nov. 6, 1992 and entitled "Programmable Filling and Capping Machine"; and U.S. Pat. No. 5,056,511 issued to Derley on Feb. 28, 1991 and entitled "Container Fill System", which U.S. patents are hereby expressly incorporated by reference herein.

Rotary mechanical devices relating to bottling are to be found in U.S. Pat. No. 5,219,405 issued to Weiss on Jun. 15, 1993 and entitled "Continuously Operating Rotational Bottle Filling Installation"; U.S. Pat. No. 4,976,803 issued to Tomashauser et al. on Dec. 11, 1990; U.S. Pat. No. 5,185,053 issued to Tomashauser et al. on Feb. 9, 1993; U.S. Pat. No. 5,174,851 issued to Zodrow et al. on Dec. 29, 1992; U.S. Pat. No. 5,217,538 issued to Buchholz et al. on Jun. 8, 1993; and U.S. Pat. No. 5,087,317 issued to Rogall on Feb. 11, 1992, all of these U.S. patents being hereby expressly incorporated by reference herein.

Examples of capping devices which may be incorporated into the present invention are to be found in U.S. Pat. No. 4,939,890 issued to Peronek on Apr. 14, 1989 and entitled "Anti-Rotation Method and Apparatus for Bottle Capping Machines"; U.S. Pat. No. 5,150,558 issued to Bernhard on Jul. 5, 1991 and entitled "Closing Mechanism for a Capping Machine"; U.S. Pat. No. 5,157,897 issued to McKee et al. on Oct. 27, 1992 and entitled "Rotary Capping Machine"; and U.S. Pat. No. 5,220,767 issued to de Santana on Jun. 22, 1993, all of these U.S. patents being hereby expressly incorporated by reference herein.

An example of an electric probe utilized in connection with a bottle filling process which may be incorporated into the present invention is to be found in U.S. Pat. No. 5,190,084 issued to Diehl et al. on May 3, 1991 and entitled "Filling Element for Filling Machines for Dispensing Liquid", which U.S. patent is hereby expressly incorporated by reference herein.

Other examples of liquid level probes which may be incorporated into the present invention are to be found in U.S. Pat. No. 4,903,530 issued to Hull on Dec. 8, 1988 and entitled "Liquid Level Sensing System"; U.S. Pat. No. 4,908,783 issued to Maier on Apr. 28, 1987 and entitled "Apparatus and Method for Determining Liquid Levels"; and U.S. Pat. No. 4,921,129 issued on Jul. 11, 1988 to Jones et al. and entitled "Liquid Dispensing Module", all of these U.S. patents being hereby expressly incorporated by reference herein.

The invention was described above primarily with reference to one embodiment. It is apparent that modifications and adaptations can be made without thereby going beyond the context of the basic teaching of the invention.

One feature of the invention resides broadly in the method for filling bottles or similar containers 7 with a liquid, using a bottling system with at least one bottling element 1 with a fluid duct 10 forming a discharge opening 12 for the liquid being bottled and having a fluid valve 16, and with at least one gas path 13, during which method the respective container 7 which is in tight contact with the bottling element 1 is primed in a priming phase by means of the gas path with an inert gas, preferably CO2 gas, whereby in a subsequent bottling phase in which, with the liquid valve 16 open, the liquid being bottled flows into the inside of the container via the discharge opening 12, the inert gas is displaced at least temporarily via the gas path into a return gas collecting duct 6, and during which method the respective container is evacuated and is flushed with inert gas in a pretreatment phase which chronologically precedes the priming phase, characterized by the fact that in the pretreatment phase, chronologically following at least a first flushing and a second flushing of the interior of the respective container 7 by the timed introduction of a specified quantity of inert gas, there is a subsequent application of an underpressure to the interior of the container 7, i.e. evacuation of the container, and that the introduction of the specified quantity of inert gas during the respective flushing is timed and takes place independently of the respective capacity at which the bottling system is being operated.

Another feature of the invention resides broadly in the method characterized by the fact that for the respective evacuation, the interior of the container 7 is connected by means of a first timed control valve system 21 to a source for the underpressure, e.g. to a vacuum duct 8.

Yet another feature of the invention resides broadly in the method characterized by the fact that, for the introduction of the specified amount of inert gas, the interior of the container 7 is connected during the respective flushing by means of a second timed control valve system 22 to a source 6 for the inert gas under pressure.

Still another feature of the invention resides broadly in the method characterized by the fact that the respective container 7 is evacuated before each flushing.

A further feature of the invention resides broadly in the method characterized by the fact that during the pretreatment phase, there is a first evacuation followed by a first flushing, then a second evacuation followed by a second flushing, and a third evacuation followed by a priming of the container 7.

Another feature of the invention resides broadly in the method characterized by the fact that the underpressure of the underpressure source and the duration of the evacuation of the container in question are selected so that an underpressure of approximately 0.5 to 0.95 bar is achieved in the respective container.

Yet another feature of the invention resides broadly in the method characterized by the fact that the flushing of the interior of the respective container 7 takes place with the inert gas from the return gas collecting duct 6, which contains the inert gas at an overpressure P2 which is less than a bottling pressure P1.

Still another feature of the invention resides broadly in the method characterized by the fact that the absolute pressure at the end of a flushing is approximately 0.3 to 2 bar, preferably approximately 0.5 bar.

A further feature of the invention resides broadly in the method characterized by the fact that the pressure of the inert gas used for the flushing or the inert gas source used for the flushing, as well as the duration of the respective flushing, are selected so that at the end of each flushing, an absolute pressure of 0.3 to 2.0 bar, preferably approximately 0.5 bar, is achieved in the respective container.

Another feature of the invention resides broadly in the method characterized by the fact that the priming of the container is accomplished exclusively from a gas duct or gas chamber 5 which contains the inert gas at the bottling pressure.

Yet another feature of the invention resides broadly in the method characterized by the fact that during the evacuation of the respective container 7, up to approximately 90% of its total volume is evacuated.

Still another feature of the invention resides broadly in the method characterized by the fact that during the respective flushing, a quantity of inert gas is introduced into the container 7 which corresponds to one-fourth of the total volume of the container 7.

A further feature of the invention resides broadly in the method characterized by the use of an inert gas source 6 at an overpressure of approximately 1 bar and/or an underpressure source 8 at an underpressure of approximately 0.9 bar.

Another feature of the invention resides broadly in the method characterized by the fact that for a total volume of the container 7 of approximately 1000 ml, at an overpressure of the inert gas source 6 of approximately 1 bar, and an underpressure of the underpressure source 8 of approximately 0.9 bar, the duration of the evacuation of the not-yet-flushed container 7 is approximately 800 msec. and the total duration of each flush with the subsequent evacuation is approximately 400 msec.

Yet another feature of the invention resides broadly in the method characterized by the fact that the duration of the respective flushing is set to approximately 80 msec.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 44 29 594.4, filed on Aug. 20, 1994, having inventors Ludwig Clüsserath and Manfred Härtel, and DE-OS P 44 29 594.4 and DE-PS P 44 29 594.4, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method for filling containers with a filling machine, the filling machine being operable at a plurality of speeds of containers per unit time and having a supply tank for containing a supply of a substance with which the containers are to be filled, at least one filling head for engaging the containers, at least one supply passage between the supply tank and the interior of a container engaged by the filling head, a return gas collection duct, a return gas passage between the return gas collection duct and the interior of a container engaged by the filling head, and control means for actuating at least some operations of the filling machine according to determined timed sequences, said method comprising the steps of:

feeding the containers into the filling machine;

engaging each of the containers with the filling head such that the interiors of each of the containers are in fluid communication with the supply passage and the return gas passage;

flushing each of the containers, said flushing step comprising the steps of:

preparing each of the containers by at least partially evacuating the interior of each of the containers of gas contained therein; and introducing a specified quantity of a substantially inert gas into the interior of each of the containers during a first determined constant time period;

preparing each of the containers for priming by again at least partially evacuating the interior of each of the containers of gas contained therein;.

priming each of the containers by introducing an inert priming gas into the interior of each of the containers;

injecting the substance with which the containers are to be filled into the interior of each of the containers;

closing each of the containers;

wherein said step of flushing additionally comprises a second flushing, said second flushing comprising the further steps of:

preparing each of the containers by yet again at least partially evacuating the interior of each of the containers of gas contained therein;

introducing a second specified quantity of said substantially inert gas into the interior of each of the containers during a second determined constant time period;

wherein both of said first determined constant time period and said second determined constant time period are independent of the speed of containers per unit time at which the filling machine is being operated;

wherein said steps of at least partially evacuating the interior of each of the containers, again at least partially evacuating the interior of each of the containers, and yet again at least partially evacuating the interior of each of the containers of gas contained therein are carried out such that a relative atmospheric pressure within the container of between about 0.5 bar and about 0.95 bar is achieved, following each of said evacuation steps;

said supply tank additionally containing a supply of said priming gas, and said method additionally comprising the further steps of:

maintaining said supply of said priming gas contained in said supply tank at a first overpressure (P1); and maintaining said return gas collecting duct at a second overpressure (P2);

said first overpressure (P1) being substantially greater than said second overpressure (P2).

2. The method for filling containers with a filling machine according to claim 1, said method additionally comprising the further steps of:

adjusting the pressure (P2) in the gas return collection duct; and adjusting both of said determined time period and said second determined time period such that:

following said step of introducing said specified quantity of said substantially inert gas, the interior of each of the containers has an absolute pressure of between about 0.3 bar and about 2.0 bar; and following said step of introducing said second specified quantity of said substantially inert gas, the interior of each of the containers has an absolute pressure of between about 0.3 bar and about 2.0 bar.

3. The method for filling containers with a filling machine according to claim 2, wherein the filling machine additionally includes a vacuum gas duct, a vacuum gas passage between the vacuum gas duct and the interior of a container engaged by the filling head, and a vacuum gas valve controlling flow through the vacuum gas passage:

said step of at least partially evacuating the interior of each of the containers comprising the step of operating the control means to open the vacuum gas valve for a third determined constant time period;

said step of again at least partially evacuating the interior of each of the containers comprising the step of operating the control means to open the vacuum gas valve for a fourth determined constant time period;

said step of yet again at least partially evacuating the interior of each of the containers comprising the step of operating the control means to open the vacuum gas valve for a fifth determined constant time period.

4. The method for filling containers with a filling machine according to claim 3, wherein the filling machine additionally includes a return gas duct providing a supply of said substantially inert gas, a return gas passage leading from the return gas duct to the interior of a container engaged by the filling head, and a return gas valve controlling flow through the return gas passage:

said step of introducing a specified quantity of a substantially inert gas into the interior of each of the containers comprising operating the control means to open the return gas valve for said determined constant time period; and said step of introducing a second specified quantity of said substantially inert gas into the interior of each of the containers comprising operating the control means to open the return gas valve for said second determined constant time period.

5. The method for filling containers with a filling machine according to claim 4, wherein each of said steps of at least partially evacuating the interior of each of the containers, again at least partially evacuating the interior of each of the containers, and yet again at least partially evacuating the interior of each of the containers removes about 90% of the gas contained within the interior of each of the containers.

6. The method for filling containers with a filling machine according to claim 5, wherein both of said specified quantity and said second specified quantity of said substantially inert gas correspond to about one-fourth of the total capacity of the containers being filled.

7. The method for filling containers with a filling machine according to claim 6, wherein said first overpressure (P1) is about 2 bar, said second overpressure (P2) is about 1 bar and said underpressure (P3) is about 0.9 bar.

8. The method for filling containers with a filling machine according to claim 7:

wherein each of the containers has a capacity of about 1000 ml;

wherein said step of at least partially evacuating the interior of each of the containers is executed during a time period of about 800 milliseconds;

wherein both of said steps of:

introducing a specified quantity of a substantially inert gas into the interior of each of the containers during a determined constant time period; and again at least partially evacuating the interior of each of the containers of gas contained therein;

are executed during a time period of about 800 milliseconds; and wherein both of said steps of:

yet again at least partially evacuating the interior of each of the containers of gas contained therein; and introducing a second specified quantity of said substantially inert gas into the interior of each of the containers during a second determined constant time period;

are also executed during a time period of about 800 milliseconds.

9. The method for filling containers with a filling machine according to claim 8, wherein each of said first and second determined constant time periods has a duration of about 80 milliseconds.

10. A method for filling containers with a filling machine, the filling machine being operable at a plurality of speeds of containers per unit time and having a supply tank for containing a supply of a substance with which the containers are to be filled, at least one filling head for engaging the containers, at least one supply passage between the supply tank and the interior of a container engaged by the filling head, a return gas collection duct, a return gas passage between the return gas collection duct and the interior of a container engaged by the filling head, and control means for actuating at least some operations of the filling machine according to determined timed sequences, said method comprising the steps of:

feeding the containers into the filling machine;

engaging each of the containers with the filling head such that the interiors of each of the containers are in fluid communication with the supply passage and the return gas passage;

flushing each of the containers, said flushing step comprising the steps of:

preparing each of the containers by at least partially evacuating the interior of each of the containers of gas contained therein; and introducing a substantially inert gas into the interior of each of the containers during a first determined constant time period;

preparing each of the containers for priming by again at least partially evacuating the interior of each of the containers of gas contained therein;

priming each of the containers by introducing an inert priming gas into the interior of each of the containers;

injecting the substance with which the containers are to be filled into the interior of each of the containers; closing each of the containers;

said supply tank additionally containing a supply of said priming gas, and said method additionally comprising the further steps of:

maintaining said supply of said priming gas contained in said supply tank at a first overpressure (P1); and maintaining said return gas collecting duct at a second overpressure (P2);

said first overpressure (P1) being substantially greater than said second overpressure (P2);

said method additionally comprising the further steps of:

adjusting the pressure (P2) in the gas return collection ducts;.

wherein said step of flushing additionally comprises a second flushing, said second flushing comprising the further steps of:

preparing each of the containers by yet again at least partially evacuating the interior of each of the containers of gas contained therein; and introducing said substantially inert gas into the interior of each of the containers during a second determined constant time period;

wherein both of said first determined constant time period and said second determined constant time period are independent of the speed of containers per unit time at which the filling machine is being operated; and wherein said steps of at least partially evacuating the interior of each of the containers, again at least partially evacuating the interior of each of the containers, and yet again at least partially evacuating the interior of each of the containers of gas contained therein are carried out such that a relative atmospheric pressure within the container of between about 0.5 bar and about 0.95 bar is achieved, following each of said evacuation steps; and adjusting both of said determined time period and said second determined time period such that:

following said step of introducing said substantially inert gas during said determined constant time period, the interior of each of the containers has an absolute pressure of between about 0.3 bar and 2.0 bar; and following said step of introducing said substantially inert gas during said second determined constant time period, the interior of each of the containers has an absolute pressure of between about 0.3 bar and about 2.0 bar;

wherein both of the quantities of said substantially inert gas introduced during said first and second determined constant time periods correspond to about one-fourth of the total capacity of the containers being filled; and wherein said first overpressure (P1) is about 2 bar, said second overpressure (P2) is about 1 bar and said underpressure (P3) is about 0.9 bar.

11. A method for filling containers with a filling machine, the filling machine being operable at a plurality of speeds of containers per unit time and having a supply tank for containing a supply of a substance with which the containers are to be filled, at least one filling head for engaging the containers, at least one supply passage between the supply tank and the interior of a container engaged by the filling head, a return gas collection duct, a return gas passage between the return gas collection duct and the interior of a container engaged by the filling head, and control means for actuating at least some operations of the filling machine according to determined timed sequences, said method comprising the steps of:

feeding the containers into the filling machine;

engaging each of the containers with the filling head such that the interiors of each of the containers are in fluid communication with the supply passage and the return gas passage;

flushing each of the containers, said flushing step comprising the steps of:

preparing each of the containers by at least partially evacuating the interior of each of the containers of gas contained therein; and introducing a first specified quantity of a substantially inert gas into the interior of each of the containers;

preparing each of the containers for priming by again at least partially evacuating the interior of each of the containers of gas contained therein;

priming each of the containers by introducing an inert priming gas into the interior of each of the containers;

injecting the substance with which the containers are to be filled into the interior of each of the containers;

closing each of the containers;

wherein said step of flushing additionally comprises a second flushing, said second flushing comprising the further steps of:

preparing each of the containers by yet again at least partially evacuating the interior of each of the containers of gas contained therein; and introducing a second specified quantity of said substantially inert gas into the interior of each of the containers;

wherein both of said first and second specified quantities of said substantially inert gas are independent of the speed of containers per unit time at which the filling machine is being operated; and wherein said steps of at least partially evacuating the interior of each of the containers, again at least partially evacuating the interior of each of the containers, and yet again at least partially evacuating the interior of each of the containers of gas contained therein are carried out such that a relative atmospheric pressure within the container of between about 0.5 bar and about 0.95 bar is achieved, following each of said evacuation steps;

said supply tank additionally containing a supply of said priming gas, and said method additionally comprising the further steps of:

maintaining said supply of said priming gas contained in said supply tank at a first overpressure (P1); and maintaining said return gas collecting duct at a second overpressure (P2);

said first overpressure (P1) being substantially greater than said second overpressure (P2);

wherein, following both of said steps of introducing said first and second specified quantities of said substantially inert gas into the interior of each of the containers, the interior of each of the containers has an absolute pressure of between about 0.3 bar and about 2.0 bar;

wherein both of said first and second specified quantities of said substantially inert gas correspond to about one-fourth of the total capacity of the containers being filled; and wherein said first overpressure (P1) is about 2 bar, said second overpressure (P2) is about 1 bar and said underpressure (P3) is about 0.9 bar.

* * * * *

UNITED STATES PATENT AND TRADEMARK OFFICE

CERTIFICATE OF CORRECTION

PATENT NO. : 5,634,500

DATED : June 3, 1997

INVENTOR(S) : Ludwig CLÜSSERATH and Manfred HÄRTEL

It is certified that error appears in the above-identified patent and that said Letters Patent is hereby corrected as shown below:

On the title page, item [73] Assignee: after 'und', delete "Alnagenbau" and insert --Anlagenbau--.

Signed and Sealed this

Twenty-third Day of September, 1997

*Attest:*

Bruce Lehman

BRUCE LEHMAN

*Attesting Officer*

*Commissioner of Patents and Trademarks*